United States Patent [19]

Diez

[11] 3,995,680

[45] Dec. 7, 1976

[54] METHOD OF COOLING PISTON BLANK MOLDS

[75] Inventor: Adolf Diez, Bad Friedrichshall-Kochendorf, Germany

[73] Assignee: Karl Schmidt GmbH, Neckarsulm, Germany

[22] Filed: Apr. 8, 1975

[21] Appl. No.: 566,152

Related U.S. Application Data

[62] Division of Ser. No. 414,494, Nov. 9, 1973, Pat. No. 3,913,660.

[30] Foreign Application Priority Data

Nov. 14, 1972 Germany ..... 2255644

[52] U.S. Cl. ..... 164/128; 164/348

[51] Int. Cl.² ..... B22D 27/04

[58] Field of Search ..... 164/340, 122, 124, 125, 164/126, 128, 346, 348, 351, 136

[56] References Cited

UNITED STATES PATENTS 3,448,790 6/1969 Maskall ..... 164/348

FOREIGN PATENTS OR APPLICATIONS 801,162 12/1950 Germany ..... 164/13[illegible]

*Primary Examiner*—Francis S. Husar
*Assistant Examiner*—John S. Brown
*Attorney, Agent, or Firm*—Burgess, Dinklage & Sprung

[57] ABSTRACT

Chill mold for casting piston blanks, e.g. for internal combustion engines, from metals such as aluminum alloys, includes a steel cylinder, an inner core for reproducing the inner contours of a piston, and a spray ring which surrounds the cylinder. The spray ring delivers cooling water to the exterior of the cylinder which flows down forming a water curtain around the cylinder.

4 Claims, 3 Drawing Figures

METHOD OF COOLING PISTON BLANK MOLDS

This is a division of application Ser. No. 414,494, filed Nov. 9, 1973 and now U.S. Pat. No. 3,913,660.

BACKGROUND

This invention relates to a chill mold consisting of a steel cylinder for making piston castings, especially from aluminum alloys, preferably for internal combustion engines, and having an inserted internal core reproducing the internal contours of the piston.

The chill casting process is assuming importance in the production of pistons from aluminum alloys. In this process the metal is cast in reusable metal molds, the molds being filled generally either by gravity or by low gas pressure. The chill casting process is well suited to the production of pistons from aluminum alloys because aluminum alloys have good castability and the casting temperatures assure that the mold can be used for a relatively long period of time — for approximately 30,000 to 50,000 castings — and thus assure good economy. Low and medium numbers of piston castings are generally made in multisectional hinged molds operated by hand, into which a multi-sectional internal core of metal, especially steel, assembled by hand, is inserted. Usually in this type of chill the piston head is facing downwardly and the pouring gate discharges into one of the two laterally mounted feeders.

For larger quantities of piston castings the use of semiautomatic casting machines is warranted, which, like the manually assembled chill, are fed with molten metal by means of a dipping ladle. The piston head in this type of casting is facing upwardly since the multi-sectional core has to be removed downwardly. Aside from pouring in the molten metal such casting machines need only the actuation of a control button in order to bring about automatically the pneumatic or hydraulic closing of the multi-sectional chill, followed by the reopening of the chill after a predetermined time and the removal of the core sections, and then the removal of the piston casting. Whereas in these above-described chill casting processes the filling of the chill is performed by gravity and the solidification takes place under air pressure, in the low-pressure casting process the metal is forced into the chill by a gas pressure of about 0.2 to 0.3 atmospheres gauge, and it hardens in the chill under this pressure. In this process the bottom aperture of the chill is located on a riser tube from a reheating furnace which contains the molten metal and is hermetically sealed with a cover. The chill, in which the piston head faces downwardly, is filled with molten metal through the riser tube. The flow of the molten metal into the chill may be controlled through the gas pressure and the inflow cross-section, so that the cavity in the chill can be filled without turbulence. Whereas small pistons are manufactured by the above-described methods, the casting of large pistons requires particularly great experience. In particular, the treatment of the melt and the foam-free injection of the metal into the chill require special measures. The large piston chills and multi-sectional steel cores, which are very heavy in comparison to chills for small pistons, are brought up to the casting furnace with cranes as a rule, and are filled directly from the tilting furnace.

The so-called fine-grain method of casting large pistons offers a substantial improvement of technological properties in comparison with the last-described method. In this process a steel cylinder having a water-cooled bottom is filled with the molten piston alloy in which a special sand core is then suspended in a precisely centered manner. Gas burners directed against the outer periphery of the steel cylinder serve to keep the melt hot and prevent the upwardly pointing thin-walled cross-sections of the piston from hardening more rapidly than the piston head. The steel cylinder is then lowered into a water bath in a timed manner causing the solidification to progress strictly from the bottom upwardly at a prescribed rate of speed. In this manner a controlled fine-grain solidification of the material is achieved, thereby creating good technological properties.

Excellent technological properties are expected not just in the case of large pistons. In fact, progress in the development of internal combustion engines towards ever increasing power output is imposing more stringent requirements on the quality of small pistons.

SUMMARY

It is the object of the present invention to develop a chill mold which will make possible the consistent application of the metallurgical principle of controlled fine-grain solidification, together with high output of both large and small pistons, at comparatively low cost.

The invention achieves this object with a chill consisting of a steel cylinder in which the internal core is suspended and which is surrounded by a water-carrying spray ring by means of which cooling water is sprayed against the outer periphery of the steel cylinder and which may be disposed, if desired, so as to be adjustable to various heights according to the manner in which the solidification is to be controlled. The cooling water flows downwardly forming a water curtain around the steel cylinder and collects, if desired, in a water collecting tank surrounding the bottom end of the steel cylinder. In this manner not only is the solidification of the metal greatly accelerated, but also solidification is made to take place in the natural direction of solidification.

DESCRIPTION OF THE DRAWING

The invention will be explained hereinafter with the aid of a number of embodiments represented in the drawings in which.

DESCRIPTION

Figure 1:
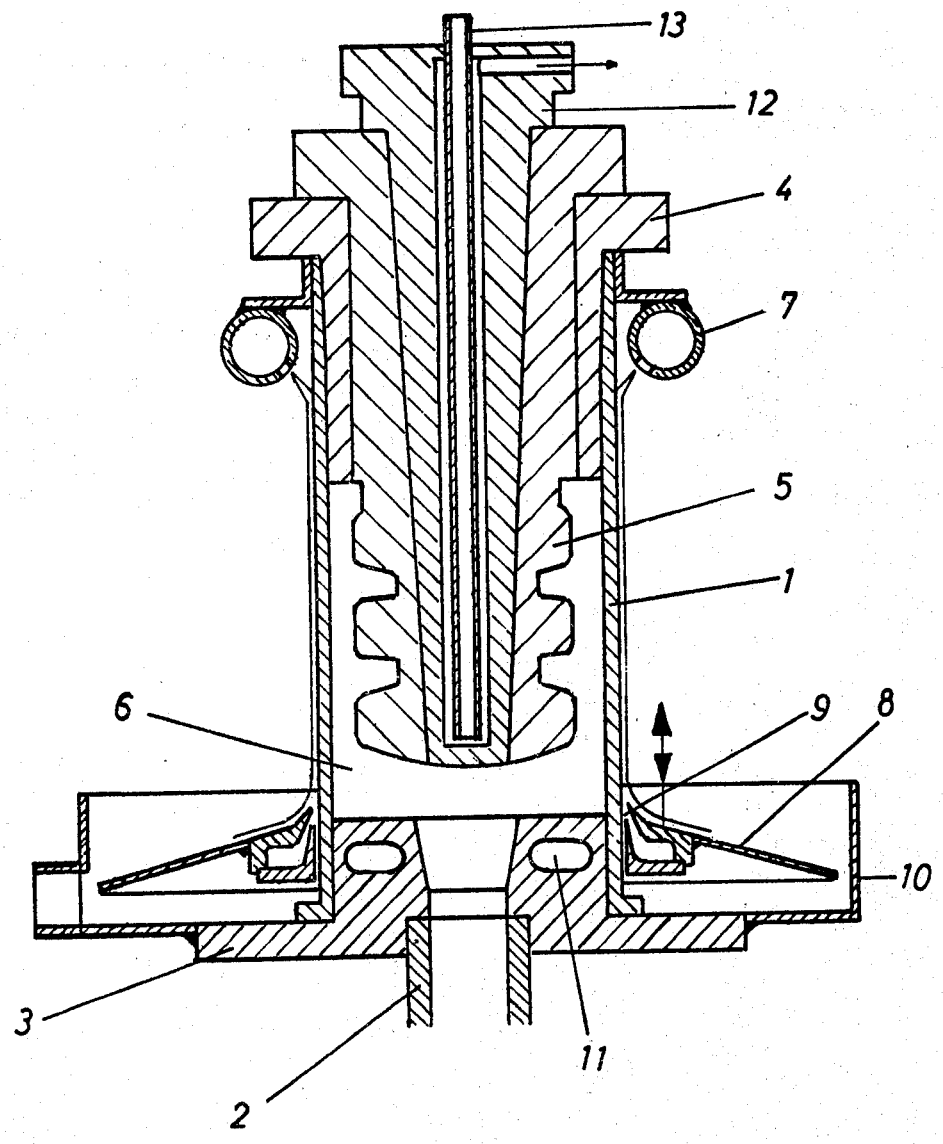
FIG. 1 is a cross-sectional view taken through a steel cylinder which is placed with its bottom aperture on a matingly constructed fitting of the riser of a low-pressure casting furnace and which has a multi-sectional, cooled steel core.
Figure 2:
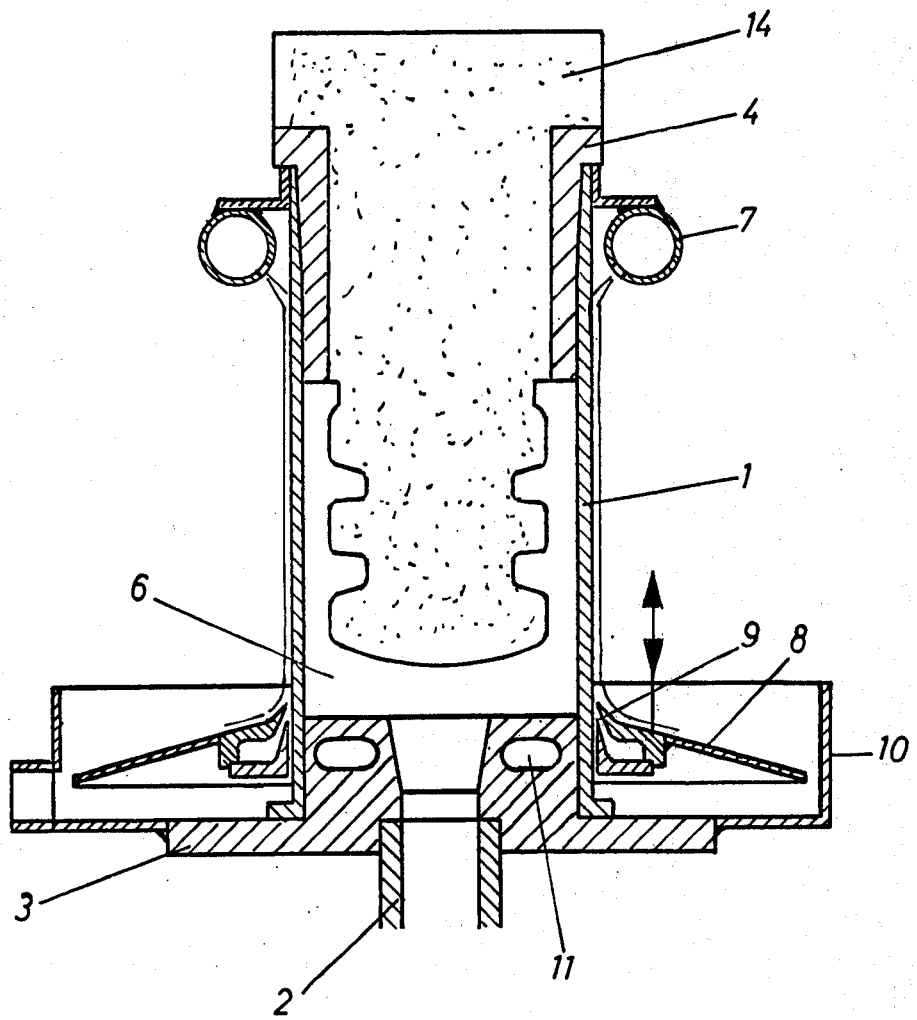
FIG. 2 is a cross-section taken through a steel cylinder placed with its bottom aperture on the matingly constructed fitting of the riser of a low-pressure casting furnace as in FIG. 1, but with a sand core.

When the chill is used in low-pressure casting systems, the water curtain produced by the spray ring may be limited in length by an annular, preferably vertically displaceable apron surrounding the steel cylinder moving downwardly in the direction of solidification at a rate depending on the desired course of the solidification, so that repeatable and optimum cooling conditions will be assured.

The water curtain can be broken away from the outer periphery of the steel cylinder by an air curtain produced in the gap formed between the inner circumference of the apron and the steel cylinder.

To enable the solidification to be controlled in an optimum manner, where the steel cylinder is filled by gravity, the spray ring may be disposed so as to be vertically displaceable, especially in a timed manner.

In the low-pressure casting process the internal core is inserted into the top aperture of the steel cylinder, and where the casting is performed by the effect of gravity it is inserted into the bottom aperture.

If instead of a sand core a multi-sectional metallic core which is inserted through a guiding collar is used, it becomes possible to cool the core in order to further accelerate the solidification process.

The steel cylinder 1 is placed with its bottom aperture on a fitting 3 which is joined to the riser 2 of the low-pressure casting furnace and whose diameter corresponds to the inside diameter of the steel cylinder 1. The cavity 6, which is formed by the multi-sectional steel core 5 or and core 14 centrally inserted by means of the core guide collar 4 into the upper aperture of the steel cylinder 1, is filled with the molten piston alloy by the application of pressure to the surface of the melt in the low-pressure casting furnace. After the filling of cavity 6, cooling water is sprayed against the outer periphery of the steel cylinder 1 through the spray ring 7 mounted adjacent the upper end of the steel cylinder 1. The curtain of water forming about the steel cylinder 1 and descending thereon is separated from the cylinder adjacent the top edge of fitting 3 by the annular apron 8 surrounding the steel cylinder in that air is injected upwardly into the gap 9 between the steel cylinder 1 and the inner circumference of apron 8. The water descending along the steel cylinder 1 collects in a water pan 10 surrounding the latter. At the appropriate time the fitting 3 may also be cooled through the annular passage 11 so as to complete solidification in a minimum of time. To accelerate solidification the central portion 12 of steel core 5 may be additionally cooled through line 13.

The feeding of the still molten metal is continued by further application of pressure to the bath surface as the solidification of the metal in the cavity progresses downwardly from the top and away from the water-cooled steel cylinder 1. When the solidification of the piston casting is completed, the casting is removed from steel cylinder 1 and then the steel core 5 or sand core 14 is removed in the conventional manner.

Figure 3:
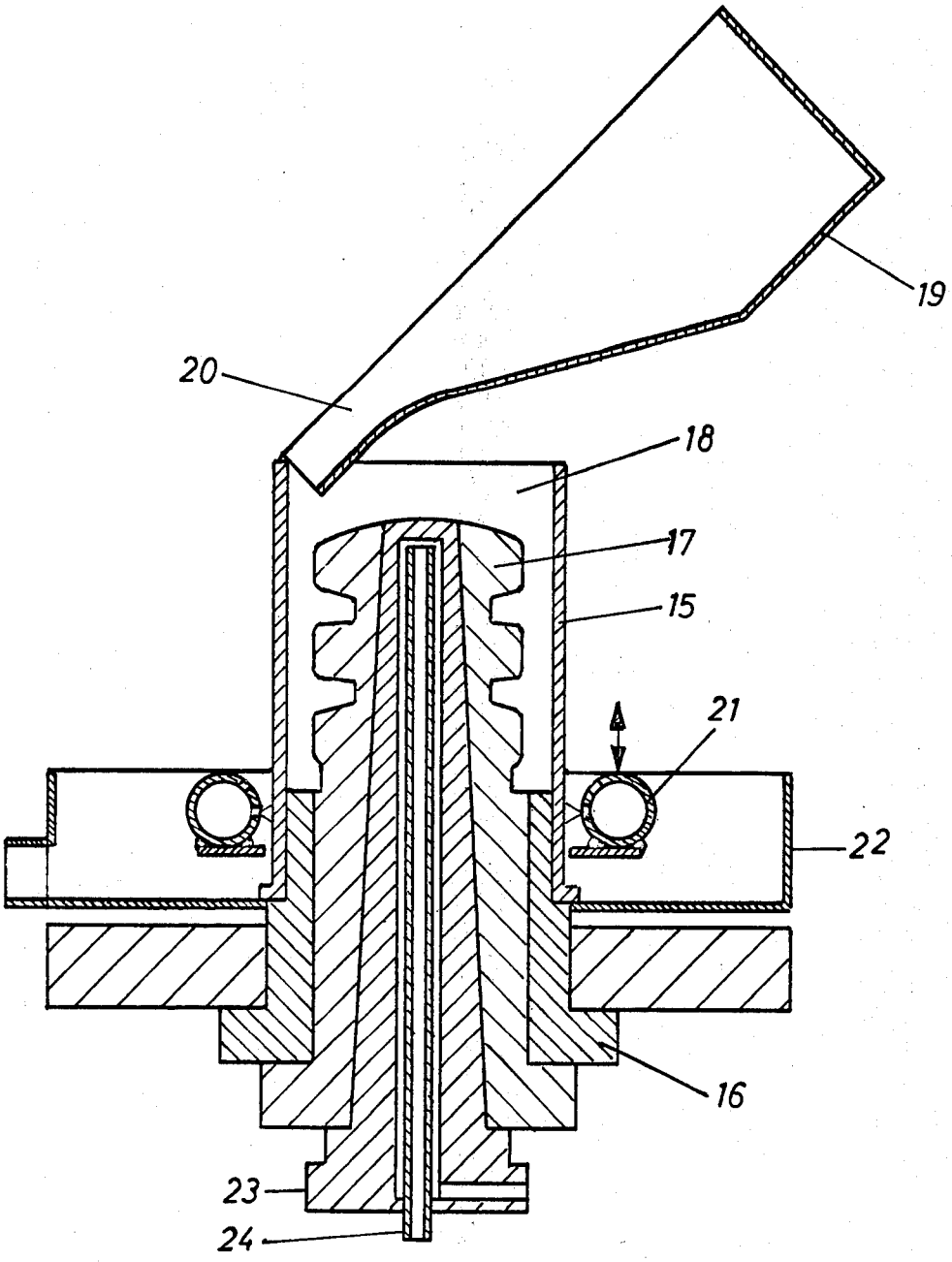
FIG. 3 is a cross-sectional view of a further embodiment of the invention.

In accordance with FIG. 3, the steel cylinder 15, whose bottom aperture is closed by a multi-sectional steel core 17 inserted into the core guiding collar 16, can be filled by the effect of gravity by pouring molten piston alloy through the upper aperture of steel cylinder 15 into the cavity 18 by means of the pouring ladle 19. The pouring ladle 19 is placed with its pouring spout 20 on the inside top edge of steel cylinder 15 in order to assure that when the molten metal flows into steel cylinder 15 no foam or oxide will form on its inner wall. The steel cylinder 15 is surrounded by the vertically displaceable spray ring 21 by which the steel cylinder 15 is covered downwardly with a curtain of water. The cooling water collects in the water pan 22 surrounding the lower end of the steel cylinder 15. The steel core 17 may be cooled through the cooling water line 24 disposed in the central portion 23 of said core. From one cycle of operation to the next it is desirable that the steel cylinder 15 be turned a certain amount about is long axis so as to equalize thermal stresses as well as wear.

The advantages achieved by the invention consist in the fact that immediately after the filling of the steel cylinder the solidification time is limited to a minimum. On account of the vertical displaceability of the apron surrounding the steel cylinder in the low-pressure casting process, and on account of the vertical displaceability of the spray ring in the case of casting by gravitational force, it is possible to achieve an optimum quality in the piston casting, without pores or voids. This means that differences in structure may be achieved corresponding to the stresses of the piston in the various zones. Soldification may furthermore be accelerated by the water cooling of the steel core. In this manner the depression that is formed in the top of the casting in gravity casting by the shrinkage of the metal upon solidification is displaced outwardly, is shallower, and corresponds to a reduction of the feedhead.

I claim:

1. Process for casting piston blanks having a head end and a skirt end in a chill mold zone defined by stationary cylinder means having an inner core means reproducing the inner contours of the piston to be cast which comprises filling said chill mold zone from the piston head end of the zone with a melt comprising an aluminum alloy and thereafter cooling said chill mold zone progressively in a direction starting from the end of the piston skirt towards the piston head by spraying cooling water against the outer periphery of said cylinder means at the skirt end of the piston, said cooling water flowing downwardly forming a water curtain around said cylinder means.

2. Process of claim 1 wherein the piston blanks are cast head end down and the water curtain is separated from the cylinder means by an annular apron surrounding the cylinder means, air being injected upwardly into the gap between the cylinder means and the inner circumference of the said apron to effect said separation.

3. Process of claim 2 wherein said annular apron is vertically displaceable to limit the length of the water curtain.

4. Process of claim 1 wherein the piston blanks are cast head end up and the water curtain is formed by a vertically displaceable spray ring means surrounds said cylinder means.

* * * * *